US006865980B2

(12) United States Patent
Jonninen

(10) Patent No.: US 6,865,980 B2
(45) Date of Patent: Mar. 15, 2005

(54) METHOD AND APPARATUS FOR RETURNING THE DRAIN OIL OF A HYDRAULIC MOTOR

(75) Inventor: Markku Jonninen, Lahti (FI)

(73) Assignee: Ideachip Oy, Hollola (FI)

( * ) Notice: Subject to any disclaimer, the term of this patent is extended or adjusted under 35 U.S.C. 154(b) by 234 days.

(21) Appl. No.: 10/283,455

(22) Filed: Oct. 30, 2002

(65) Prior Publication Data

US 2003/0085076 A1 May 8, 2003

(30) Foreign Application Priority Data

Nov. 5, 2001 (FI) ..... 20012134

(51) Int. Cl.[7] ..... F03C 1/04
(52) U.S. Cl. ..... 92/86; 92/154; 60/456
(58) Field of Search ..... 92/86, 80, 154, 92/156; 60/455, 456, 464, 487

(56) References Cited

U.S. PATENT DOCUMENTS 2,298,850 A * 10/1942 Vickers ..... 91/487
2,455,330 A * 11/1948 Denison, Jr. ..... 91/486
4,762,479 A * 8/1988 Uppal ..... 418/61.3

FOREIGN PATENT DOCUMENTS

| | | | |
|---|---|---|---|
| DE | 29 46 590 | 6/1980 | ..... F03C/1/00 |
| DE | 43 04 403 | 8/1993 | ..... F15B/11/02 |
| EP | 0 534 067 | 3/1993 | ..... F04B/21/00 |
| WO | WO 01/65113 | 9/2001 | ..... F04B/53/04 |

* cited by examiner

*Primary Examiner*—F. Daniel Lopez
*Assistant Examiner*—Igor Kershteyn
(74) *Attorney, Agent, or Firm*—Synnestvedt & Lechner LLP

(57) ABSTRACT

The invention relates to a method and apparatus for returning the oil drained from a working pressure space of a hydraulic motor into a motor casing to an oil line, which is connected to the motor and which is in communication via a divider with intra-motor flow channels which are in communication with the working pressure spaces. The oil seeping into the casing is conveyed by means of pressure variations internal of the hydraulic motor, pulsating consistently with rotating motion, into the oil line presently at a lower pressure and connected to the motor by way of said divider. Therefor, the casing space is connected by a return conduit through a one-way valve to at least one flow channel, which lies between the divider of the motor and the working pressure space of the motor.

18 Claims, 1 Drawing Sheet

METHOD AND APPARATUS FOR RETURNING THE DRAIN OIL OF A HYDRAULIC MOTOR

RELATED APPLICATIONS

This application is based on and claims priority to Finnish Application No. 20012134, filed Nov. 5, 2001.

FIELD OF THE INVENTION

The invention relates to a method and apparatus for returning the oil drained into a casing of a hydraulic motor to an oil line, which is connected to the motor and which is in communication via a divider with intra-motor flow channels which are in communication with working pressure spaces of the motor.

BACKGROUND OF THE INVENTION

Hydraulic motors are used for applications requiring plenty of torque, performance, constant reversals of rotary drive directions, or a compact size. Hydraulic motors can also be used when conditions are difficult; such as humidity, dustiness, or a high temperature. In mobile equipment, hydraulic drive has almost completely superseded other drives by virtue of these benefits.

Until now, it has been necessary to provide heavy-duty hydraulic motors with three or four hydraulic lines. Pressure and return lines are always included, but often the system comprises also a so-called drain line, whereby the hydraulic fluid draining into a motor casing is returned to the tank and recirculation. Larger motors, in particular, are always provided with a drain line. The pressure of oil draining into a casing would rise at least to equal the pressure of a return line if there was no drain line. In practice, such a pressure is not acceptable. Four lines are required in the system if a separate cool-down flushing circulation is provided for the casing.

Many hydraulically operated systems, such as bucket machines, employ primarily hydraulic cylinders to work. Hydraulic cylinders do not require a drain connection and, thus, the hydraulic piping of bucket machines does not include a drain oil line as a standard feature and, therefore, it must be separately installed for a hydraulic motor included in an accessory, for example. It is also often the case that a hydraulic motor must be installed far away from the actual pump or tank, resulting in a long drain line. Especially in equipment, operating deep underwater or in mines, the extra line causes problems and more expenses. If the drain oil connection could be omitted, the coupling of a motor-equipped actuator with any hydraulic system would be simpler.

In order to enable the oil seeped into a casing to proceed to main lines, the pressure level of such oil should be raised to be equal to or higher than the pressure of a receiving line, without increasing pressure in the casing. This elevation of pressure can be performed with a pump. A problem here is driving power for the pump, since the number of hydraulic links must not increase. If the energy is picked up directly from the oil stream and pressure difference between pressure and return lines, the system requires in practice at least a hydraulic motor and a pump. Reversal of the rotating direction must also be taken into account in the system configuration. In order to make the system as simple as possible, the extra motor is not worth installing but, instead, it is reasonable to implement this type of solution by using the method disclosed in the Applicant's patent application WO 01/65113, wherein driving power for the pump is taken directly from the shaft of a main motor.

In an effort to further simplify the design and in search of alternative sources of driving power, it has been discovered in the invention to utilize pressure differences existing in the system. Outside the divider of a motor, the pressure in a working line, as the motor is running, is always higher than in a return line, and the pressure difference does not fluctuate if the loading does not fluctuate. In practice, this denies the use of a simple pump for the removal of drain oil in a solution effected outside the divider.

The invented solution involved the use of intra-motor pressure differences. Hydraulic motor must always have an element which opens flow channels for oil flowing in and out of the motor in order to enable the actuators, such as pistons, to set the output shaft in rotation. This element, which is referred to as a divider, may comprise for example a rotating wheel provided with channels for guiding the flow of hydraulic fluid in and out of intra-motor channels, or a valve type solution capable of corresponding actions. Thus, the intra-divider oil channels or channel are or is pressurized in pulses according to rotation. Since one and the same channel functions alternately as a working or pressure channel and alternately as a return channel, said channel experiences alternately over a single cycle both a high working pressure and a low return pressure. The magnitude of a pressure difference in the channel over a single cycle varies according to loading. It should be appreciated that this pressure pulse also develops in the channels even if the motor is under uniform loading or idling.

BRIEF DESCRIPTION OF THE DRAWINGS

The features characteristic of the invention will be described in more detail by way of exemplary embodiments with reference to the accompanying drawings, in which.

DETAILED DESCRIPTION OF THE PREFERRED EMBODIMENT

Figure 1:
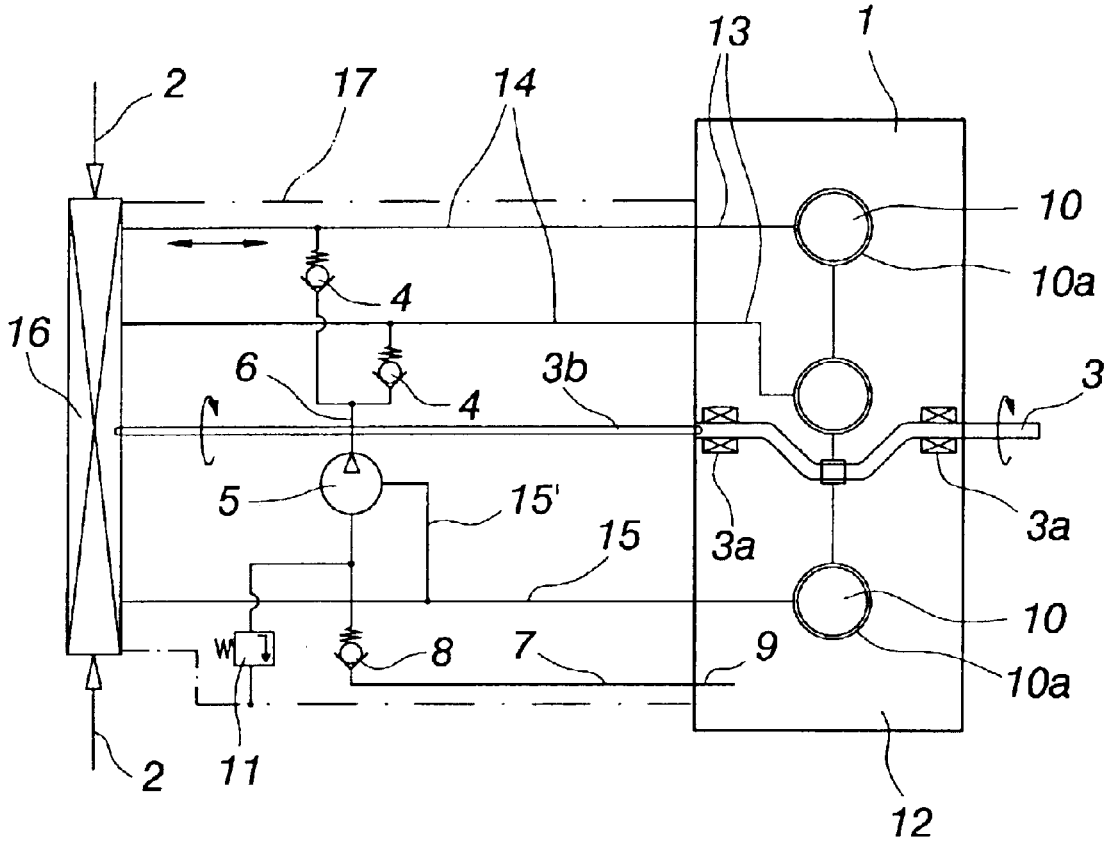
FIG. 1 shows schematically an apparatus 17 according to one embodiment of the invention, fitted between a divider 16 and the frame of a motor 1.

The hydraulic motor 1 has its working pressure spaces 10*a* connected by way of internal flow channels 13 and the flow divider 16 with oil lines 2 of the motor. When one oil line 2 is pressurized, the other functions as a return line. The pressure and return lines 2 switch places according to which way the motor 1 is driven. The motor 1 may comprise e.g. a radial piston motor, having its pistons shown at 10 and cylinders at 10*a*. In this case, the cylinders 10*a* constitute working pressure spaces, for which the divider 16, while rotating, distributes inlet and outlet flows of the oil lines 2 through the channels 13.

Over a single revolution of a crankshaft 3, each piston 10 performs a single working stroke from the top dead centre to bottom dead centre and, respectively, a single return stroke from the bottom dead centre to top dead centre. Accordingly, the direction of flow in each flow channel 13 is reversed every time the relevant piston 10 passes the bottom dead centre or the top dead centre. Hence, this reversal of flow direction is handled by the divider 16, which is rotated by the crankshaft 3 with the help of a suitable extension shaft 3*b*.

From one or more flow channels 13 extend small drain conduits to bearings 3*a* of the crankshaft 3 for lubricating the same. Drain oil from the lubrications and the working pressure spaces 10*a* accumulates in a casing 12 of the motor 1. Drain oil is discharged from the casing 12 to the presently lower-pressure oil line 2 by means of an apparatus 17 of the invention, which is coupled between the divider 16 and the frame of the motor 1 and which is described more fully hereinafter.

The apparatus 17 has its body or frame provided with flow channels 14, 15 functioning as extensions to the flow channels 13. According to the invention, it has been discovered that the oil seeping into the casing is conveyed by means of pressure differences pulsating in the channels 13, 14, 15 according to rotating motion of the motor, and by means of pressure differences created as a consequence thereof, to the oil line 2 presently at a lower pressure. The greatest pressure difference between the channels 14, 15 develops between a channel (e.g. channel 15) extending to a presently working piston 10 and the channel 14 for a piston 10 presently at the bottom dead centre, because one contains a maximum pressure and the other, as the incoming oil stream is blocked by the divider 16, contains a low pressure.

The casing space 12 is connected over a return channel 7 and a one-way valve 8 to a return pump 5, which receives its driving power from the flow channel 15 extending between the divider 16 and one of the working pressure spaces 10*a* of the motor. A return conduit 6 extending from the pump 5 is branched and the branches are connected through one-way valves 4, each to its assigned flow channel 14. Downstream of the pump 5, even a single channel would be sufficient, but the bifurcate return channel 6 is used to ensure a lowest back-pressure.

Figure 2:
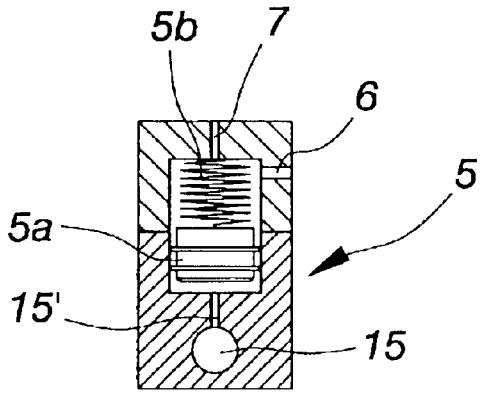
FIG. 2 shows a return pump 5 for the apparatus of FIG. 1, in a schematic sectional view, according to one feasible embodiment.

FIG. 2 illustrates a structural principle for the pump 5. The flow channel 15 from the divider 16 to the cylinder 10*a* is connected by a conduit 15' to a space defined by a piston 5*a*. As pressure increases in the channel 15, the piston 5*a* compresses a spring set 5*b* and drives the oil from one side of the piston 5*a* into the low-pressure conduit 6. The one-way valves 4 and 8 may have an opening pressure of e.g. 1,5 bar. The casing 12 may have its maximum pressure limited to e.g. 5 bar by means of a pressure relief valve 11. The spring 5*b* compresses with a full working pressure and drives the casing fluid into the return channel 6, 14, 2. The spring 5*b* drives the piston 5*a* back and makes room for the casing fluid. The spring 5*b* must be dimensioned to exceed the pressure level of a return line and to fall short of the lowest level of working pressure, with regard to pressures existing on both sides of the piston 5*a*, for enabling the same to drive the piston 5*a* back to the initial position.

The return conduit 7, 6 may have its starting point 9 e.g. in the vicinity of a bearing assembly for the crankshaft 3 or within a rotation space for the shaft 3*b* between the divider 16 and the crankshaft 3.

In an alternative embodiment of the invention, there is no need for a specific return pump 5. In this co-existing embodiment, the motor divider 16 has its divider disc or respective control system, whereby the flow of oil is distributed to working elements 10 of the motor, designed in such a fashion that the oil stream bound for working elements, such as the pistons 10, is not blocked at an optimally correct time, as in traditional design, but an advanced blocking of the oil stream is effected to intentionally develop a negative pressure or at least a pressure lower than the low casing pressure of the motor in the flow channel 13 of a working element 10 moving towards the bottom dead centre set between a working stroke and a return stroke of the working element 10, in response to which the working element 10 sucks oil momentarily through the one-way valve 8 or 4 from the casing 12 which contains a low pressure. Thus, there is no need for a separate return pump 5 or any other separate unit for increasing pressure of the casing oil, since a piston 10 or a similar working element of the motor itself brings also the pressure of this oil drained from the casing 12 up to the pressure of a return line.

In the latter type of solution, the lowest pressure develops immediately behind a divider disc blocking the channel 14, since the movement of oil strives to carry on even after the channel 14 is blocked. The casing oil conduit 6, 7 coupled to this low-pressure section may drive oil through the one-way valve 4 or 8 into a line extending to the piston 10. When the piston 10 passes the bottom dead centre, the pressure rises, the reactor valve 4 or 8 shuts off, and the piston 10 conveys the oil into the return channel 2/14 in a normal fashion.

In practice, the latter method functions even without any modifications to the disc of the divider 16 since, downstream of the divider 16, pressure in the channel 14 at the bottom dead centre of a respective piston 10 falls substantially below 5 bar, whereby the drain oil flows from the higher pressure of the casing 12 into the flow channel 14 of a piston 10 presently at its bottom dead centre after the flow is blocked by the divider 16. Of course, there is a quantitative limit to this volume flow, as the divider remains in a blocking position for only a short time.

If the above-described discharge possibility of casing oil is born in mind in designing the divider 16, for example the edge of divider disc holes, which is closer to the bottom dead centre, can be advanced e.g. by 2%, whereby the oil stream arriving on top of the piston discontinues 2% earlier and, thus, pressure at the bottom dead centre atop the piston 10 diminishes as compared to a standard situation. This suction volume and vacuum is utilized by drawing an equivalent amount of oil through the one-way valve 4 or 8 from the casing 12.

A simple pressure accumulator can also be substituted for a pump in systems, wherein the motor only rotates for short periods or the rotating direction is reversed frequently. Since the accumulator draws in drain oil throughout the working process at a pressure of 0–5 bar, for example, the pressure of a return line, as the motor is shut down, falls momentarily to a very low level in the internal channel 13, 14, and the same happens when reversing the direction. Since there is a reactor valve 4 in between, the oil is immediately driven by the accumulator into the low-pressure channel 14. However, this solution is only viable in a service, wherein the continuous rotating period is comparatively short. In any case, the system could only have installed therein a pressure accumulator with a capacity of no more than a few liters and, thus, the continuous service could extend from a few minutes to a few tens of minutes, depending on the amount of drainage. There are applications, however, in which the continuous driving period is typically no more than a few tens of seconds at a time.

No matter whether a return pump 5 or an appropriately designed divider 16 is used, it is possible to provide a circulatory casing flush for a hydraulic motor, which is generally used for increasing a continuous performance delivered by the motor. In accordance with the efficiency of a motor, the performance or output is often restricted by a thermal stress which in continuous operation limits operating performance of the motor. This thermal stress is generally compensated for by providing the motor casing with an extra oil circulation for taking away some of the thermal stress. This oil circulation is an independent circuit provided with its own pump, and often also with a thermal protector and pressure relief valves for the reason of safety.

In one application of the invention, the casing of a motor 11 can be provided with a flushing circulation by increasing intentionally e.g. the flow of lubricating oil bound for the bearings 3*a*, by the amount which corresponds to a desired flushing circulation. This increased drainage into the casing is compensated for either by the return pump 5 or by changing the shutting advance of the divider 16 at the bottom dead centres of those pistons 10, the respective flow channels 14 in communication therewith being joined by the return conduit 6. In this implementation, only two hydraulic hoses are needed from a motor to a pump or a tank, instead of four hoses used at present. The overall system is also much simpler.

In a situation that the motor is stopped by a motor overload, i.e. the shaft 3 is not rotating, yet the return line 2 contains a full pressure, there will be oil leaking or draining into the casing 12, which cannot be pumped away just then. Therefor, in connection with the motor 1 or the divider 16 or the inventive compensation 17 can be arranged a pressure accumulator, which is capable of receiving the casing leak for a short time. Upon a restart of the motor, the compensator 17 drains the pressure accumulator along with the casing oil stream. Thus, the system is able to tolerate longer overload situations. For example, a 1 dl 5 bar pressure accumulator provides a standard 60 kW hydraulic motor, whose drainage is normally 1–2 dl/min, with a time window of 30 seconds to 1 minute to respond to the situation.

Normally, the response time of 2–5 seconds is sufficient. In an automated system, the time frame is of course shorter than in manual service based on visual contact.

The described operating solution for a pump functions optimally in practically all systems, wherein the loading and driving of a motor are controlled by automatics, which stops a hydraulic flow to the motor or reverses the direction of flow if the motor shuts off as a result of overload. In a shut-down condition, if a line extending to the motor remains pressurized, the drain or leak into the casing continues, whereby the casing pressure relief valve 11 is before long forced to let the draining fluid out of the system. This type of situation can be avoided by means of a motor drive monitoring sensor or a pressure sensor, the information provided thereby being used for controlling the motor in such a way that the pressurized shutdown remains very short.

However, if the question is about a system controlled by the operator manually, or if a pressurized shutdown is desired, the system can be provided with a pressure accumulator coupled directly to the motor or pump, which takes up the leaking or draining casing oil for a desired period of time.

What is claimed is:

1. An apparatus for returning the oil drained from a working pressure space of a hydraulic motor into a motor casing to an oil line, which is connected to the motor and which is in communication via a divider with intra-motor flow channels between the divider and the motor which are in communication with the working pressure spaces, wherein the casing space is connected by a return conduit through a one-way valve to at least one flow channel, which lies between the divider of the motor and the working pressure space of the motor.

2. An apparatus as set forth in claim 1, wherein the return conduit is provided with a return pump, which draws its driving power from pressure variations in a flow channel extending between the divider of the motor and the working pressure space of the motor.

3. An apparatus as set forth in claim 2, wherein on either side of the return pump the return conduit is provided with a one-way valve, and that both one-way valves have the same direction of flow from the casing to the flow channel which extends between the divider and the working pressure space of the motor.

4. An apparatus as set forth in claim 2, wherein the return pump comprises a spring-loaded piston pump.

5. An apparatus as set forth in claim 1, wherein the divider linking the motor oil lines to the intra-motor flow channels is adapted to create in at least one flow channel a pressure substantially lower than the casing pressure.

6. An apparatus as set forth in claim 5, wherein the divider is adapted to discontinue the flow communication to at least one intra-motor flow channel shortly before a reversal of flow direction for a flow directed away from the motor.

7. An apparatus as set forth in claim 1, wherein an apparatus is located between the divider and a frame of the motor.

8. An apparatus as set forth in claim 1, wherein the amount of drain oil from a motor is intentionally increased to provide a flushing circulation corresponding to a desired elimination of thermal stress, and the increased casing drain is compensated for by an apparatus.

9. A method for the return of oil drained into the casing of a rotating hydraulic motor to a supply of oil for operating the motor, wherein said hydraulic motor includes a cyclically operable divider driven by said motor, intra-motor flow channels located between the divider and the motor working spaces for the supply of oil from a source to the motor and the return of oil to the source, wherein said method comprises delivering the oil drained into the casing of the motor by use of pressure differences in said intra-motor flow channels, said pressure differences being generated by pressure variations occurring upon rotary motion of the motor upon operation thereof, said oil being delivered into at least one of said intra-motor flow channels and through said divider to said source.

10. A method as set forth in claim 9, wherein the method further comprises intentionally increasing the amount of drain oil from a motor to provide a flushing circulation corresponding to a desired elimination of thermal stress, and the increased casing drain is compensated for.

11. A method as set forth in claim 9, wherein the method further comprises generating the pressure variations by changing the advance of the divider to momentarily create in at least one said intra-motor flow channels a pressure substantially lower than the pressure in said casing, said divider providing a flow path from said at least one intra-motor flow channel to said source.

12. An apparatus for returning the oil drained from a working pressure space of a hydraulic motor into a motor casing to an oil line, which is connected to the motor and which is in communication via a divider with intra-motor flow channels between the divider and the motor which are in communication with the working pressure spaces comprising an oil return conduit connecting said casing to at least one of said intra-motor flow channels, said return conduit having a one-way valve allowing oil flow from the casing and blocking flow in the opposite direction, said apparatus further including means responsive to a pressure in at least one of said intra-motor flow channels lower than the pressure in another of said channels for return of said oil from said casing through said one-way valve to said source through said divider.

13. An apparatus as set forth in claim 12, further comprising a return pump in said return conduit, said return pump being responsive to pressure variations in at least one of said intra-motor flow channels to draw oil from said casing through said return conduit to said source through said divider.

14. An apparatus as set forth in claim 13, further including one-way valves disposed in said return conduit on each side of said return pump, said one-way valves blocking flow of oil from the intra-motor flow channels to the motor casing.

15. An apparatus as set forth in claim 14, wherein said return pump comprises a spring-loaded piston pump, said piston being spring biased to a retracted position in which the pump receives drain oil from the motor casing and wherein said drain oil received by the pump is returned to the oil supply in response to a pressure difference between at least two of said intra-motor flow channels.

16. An apparatus as set forth in claim 12, wherein said divider cyclically produces a pressure lower than the motor casing pressure in one of said at least two intra-motor flow channels.

17. An apparatus as set forth in claim 16, wherein said divider cyclically discontinues flow to said one of said at least two intra-motor flow channels shortly before a reversal of flow direction for a flow directed away from the motor.

18. An apparatus asset forth in claim 12, wherein the amount of drain oil from a motor is intentionally increased to provide a flushing circulation corresponding to a desired elimination of thermal stress, the increasing casing drain being returned through at least one intra-motor flow channel in response to a pressure in said at least one intra-motor flow channel lower than said casing pressure.

* * * * *